US008439467B2

(12) United States Patent
Yoshida

(10) Patent No.: US 8,439,467 B2
(45) Date of Patent: May 14, 2013

(54) IMAGE FORMING DEVICE THAT PERFORMS BI-DIRECTIONAL PRINTING WHILE CALIBRATING CONVEYING AMOUNT OF RECORDING MEDIUM

(75) Inventor: Yasunari Yoshida, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 694 days.

(21) Appl. No.: 12/612,822

(22) Filed: Nov. 5, 2009

(65) Prior Publication Data

US 2010/0110133 A1 May 6, 2010

(30) Foreign Application Priority Data

Nov. 6, 2008 (JP) ..... 2008-285313

(51) Int. Cl.
*B41J 29/38* (2006.01)

(52) U.S. Cl.
USPC ..... 347/14; 347/104

(58) Field of Classification Search ..... None
See application file for complete search history.

(56) References Cited

U.S. PATENT DOCUMENTS 6,128,098 A * 10/2000 Kamada et al. ..... 358/1.8
6,454,390 B1 9/2002 Takahashi et al.
6,547,362 B2 * 4/2003 Subirada et al. ..... 347/19
2005/0062785 A1 * 3/2005 Oguri et al. ..... 347/19
2007/0176955 A1 * 8/2007 Yoshida ..... 347/16

FOREIGN PATENT DOCUMENTS

JP H08-216456 A 8/1996
JP H11-291470 A 10/1999
JP 2004-188680 A 7/2004
JP 2005-096131 A 4/2005
JP 2005-125699 A 5/2005
JP 2005125699 A * 5/2005
JP 2006-192636 A 7/2006
JP 2006-218774 A 8/2006

OTHER PUBLICATIONS

INPIT translation of JP 2005125699 a foreign patent document (formatted).*
Japan Patent Office, Office Action for Japanese Patent Application No. 2008-285313, mailed Aug. 17, 2010. (Counterpart to above-captioned U.S. patent application.).

* cited by examiner

*Primary Examiner* — Mark Robinson
*Assistant Examiner* — Andrew Jordan
(74) *Attorney, Agent, or Firm* — Baker Botts L.L.P.

(57) ABSTRACT

An image forming device includes a print head that performs a bi-directional printing including a forward print and a reverse print, and a convey-amount determining unit that determines a conveying amount based on a value relating to an amount of offset between a first position on the recording medium at which a first test image is formed in the forward print and a second position at which a second test image is formed in the reverse print. The recording medium is conveyed the conveying amount prior to one of the forward print and the reverse print.

6 Claims, 8 Drawing Sheets

IMAGE FORMING DEVICE THAT PERFORMS BI-DIRECTIONAL PRINTING WHILE CALIBRATING CONVEYING AMOUNT OF RECORDING MEDIUM

CROSS REFERENCE TO RELATED APPLICATION

This application claims priority from Japanese Patent Application No. 2008-285313 filed Nov. 6, 2008. The entire content of this priority application is incorporated herein by reference.

TECHNICAL FIELD

The present invention relates to an image forming device that perform bi-directional printing.

BACKGROUND

In a bi-directional printing operation, a print head reciprocated in a main scanning direction prints (i.e., ejects ink) while moving in both forward and reverse directions. In the following description, print performed by the print head while moving in the forward direction will be referred to as "forward print", and print performed while moving in the reverse direction will be referred to as "reverse print". In other words, the print head performs the forward print and the reverse print while reciprocatingly moving in the main scanning direction.

In such bi-directional printing operations, printing positions on a recording medium at which ink is ejected in the forward print and the reverse print may be offset from each other with respect to the main scanning direction. For example, when forming a vertical ruled line along a sub-scanning direction, a phenomenon called "ruled line offset" may occur in which the position of the ruled line formed in the forward print is offset in the main scanning direction from the position of the ruled line formed in the reverse print.

A method for aligning the printing positions in this type of situation has been proposed. This method finds a parameter indicating the printing positions in the forward and reverse directions that are most closely aligned and sets a printing start timing for printing in the reverse direction based on the parameter in order to reduce the occurrence of ruled line offset.

At the same time, there is market demand for inexpensive printers. Most manufacturers are able to offer low-cost printers by keeping down the costs of the mechanical structure therein. However, when using an inexpensive mechanical structure in a printer, the print head may become offset in the sub-scanning direction during a bi-directional printing operation, depending on whether the print head is being conveyed in the forward direction or the reverse direction, resulting in a decline in image quality.

SUMMARY

In view of the foregoing, it is an object of the present invention to provide an image forming device, a control method, and a control program capable of preventing a decline in image quality caused by positional deviation in a sub-scanning direction of a print head when the print head is conveyed in each direction during bi-directional printing operations.

It is an object of the invention to provide an image forming device including a print head, a moving mechanism, a storing unit, a conveying mechanism, and a conveying-amount determining unit. The print head forms an image on a recording medium. The moving mechanism moves the print head reciprocatingly in a forward direction and a reverse direction opposite from the forward direction, and the print head performs bi-directional printing including a first print for forming a first image while being moved in the forward direction and a second print for forming a second image while being moved in the reverse direction. A storing unit stores a value relating to an amount of offset in a conveying direction between a first position on the recording medium at which a first test image is formed in the first print when the recording medium is at a predetermined position and a second position on the recording medium at which a second test image is formed in the second print when the recording medium is at the predetermined position. The conveying direction is orthogonal to both the forward direction and the reverse direction. The conveying mechanism conveys the recording medium in the conveying direction relative to the print head. The conveying mechanism conveys the recording medium a first amount prior to one of the first print and the second print and a second amount prior to the other of the first print and the second print. The convey-amount determining unit determines the second amount based on the value stored in the storing unit.

According to another aspect, the present invention provides a control method for controlling an image forming device. The image forming device includes a print head that performs a bi-directional printing including a first print for forming a first image on a recording medium while moving in a forward direction and a second print for forming a second image on the recording medium while moving in a reverse direction opposite from the forward direction. The control method includes determining whether a current print is the first print or the second print, performing a first control if the current print is one of the first print and the second print, and performing a second control if the current print is the other of the first print and the second print. The first control includes conveying the recording medium a first amount in a conveying direction orthogonal to both the forward direction and the reverse direction, and performing the one of the first print and the second print. The second control includes obtaining a second amount based on a value stored in a storing unit of the image forming device, conveying the recording medium the second amount in the third direction, and performing the other of the first print and the second print. The value relates to an amount of offset in the conveying direction between a first position on the recording medium at which a first test image is formed in the first print when the recording medium is at a predetermined position and a second position on the recording medium at which a second test image is formed in the second print when the recording medium is at the predetermined position.

According to still another aspect, the present invention provides a storage medium storing a set of program instructions executable on a data processing device and usable for controlling an image forming device. The image forming device includes a print head that performs a bi-directional printing including a first print for forming a first image on a recording medium while moving in a forward direction and a second print for forming a second image on the recording medium while moving in a reverse direction opposite from the forward direction. The instructions includes determining whether a current print is the first print or the second print, performing a first control if the current print is one of the first print and the second print, and performing a second control if the current print is the other of the first print and the second print. The first control includes conveying the recording medium a first amount in a conveying direction orthogonal to both the forward direction and the reverse direction, and performing the one of the first print and the second print. The second control includes obtaining a second amount based on a value stored in a storing unit of the image forming device, conveying the recording medium the second amount in the third direction, and performing the other of the first print and the second print. The value relates to an amount of offset in the conveying direction between a first position on the recording medium at which a first test image is formed in the first print when the recording medium is at a predetermined position and a second position on the recording medium at which a second test image is formed in the second print when the recording medium is at the predetermined position.

BRIEF DESCRIPTION OF THE DRAWINGS

The particular features and advantages of the invention as well as other objects will become apparent from the following description taken in connection with the accompanying drawings, in which:

FIG. 2 (*b*) is a side view of the convey unit;

FIG. 3(*b*) is a flowchart representing a calibration value acquisition process according to the embodiment;

FIG. 4(*b*) is a view conceptually illustrating print results of the adjustment pattern printing process when offset occurred between a forward head position and a reverse head position;

FIG. 6(*b*) is a view conceptually illustrating printing results obtained when executing the normal printing process in FIG. 5;

FIG. 8(*b*) is a view conceptually illustrating results of overlap printing when the reverse head position is shifted downstream of the forward head position in the paper-conveying direction.

DETAILED DESCRIPTION

An image forming device according to an embodiment of the invention will be described while referring to the accompanying drawings. This embodiment pertains to a printer 1 shown in FIG. 1. The term "below" and the like will be used throughout the description assuming that the printer 1 is disposed in an orientation in which it is intended to be used.

Figure 1:
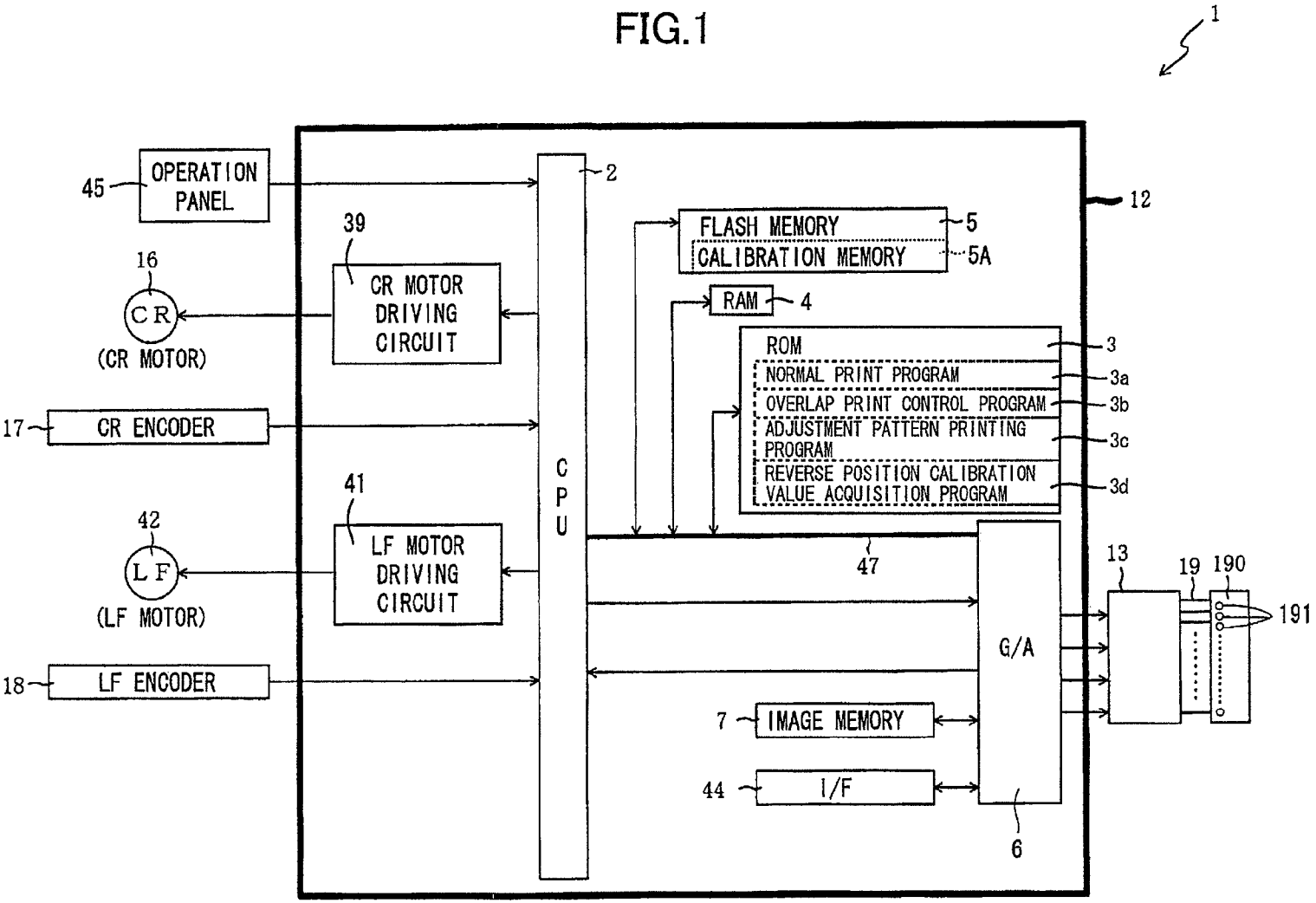
FIG. 1 is a block diagram showing an electrical configuration of a printer according to an embodiment of the present invention.

The printer 1 is an inkjet printer that performs bi-directional printing for forming color images on a recording medium by ejecting ink of different colors from an ink head 190 shown in FIG. 1. That is, the ink head 190 performs a forward print and a reverse print for forming images on the recording medium while moving in a forward direction and a reverse direction.

As shown in FIG. 1, the printer 1 includes a control board 12 and a carriage board 13, together function as a control device. The control board 12 includes a CPU 2, a ROM 3, a RAM 4, a flash memory 5, an image memory 7, a gate array (G/A) 6, and an interface (I/F) 44. The ROM 3, the RAM 4, the flash memory 5, and the gate array 6 are connected to the CPU 2 via a bus line 47.

The ROM 3 stores various control programs including a normal printing control program 3*a*, an overlap printing control program 3*b*, an adjustment pattern printing program 3*c*, and a calibration value acquisition program 3*d*, and also stores fixed value data. The RAM 4 is for temporarily storing various types of data. The flash memory 5 includes a calibration memory 5*a* for storing a reverse printing position calibration value (hereinafter referred to simply as "calibration value") to be described later.

The CPU 2 executes various processes based on the control programs stored in the ROM 3. For example, based on the control programs, the CPU 2 processes input image data and stores the processed image data into the image memory 7, or the CPU 2 generates print timing signals and transfers the same to the gate array 6.

The CPU 2 is connected to and controls an operation panel 45 on which a user inputs various command. The CPU 2 is also connected to and controls a carriage (CR) motor driving circuit 39, a CR encoder 17, a line feed (LF) motor driving circuit 41, and an LF encoder 18.

The CR motor driving circuit 39 is connected to a CR motor 16 for driving the same. The CR motor 16 is for reciprocatingly moving a carriage 60 (FIG. 2) in the main scanning direction (a forward direction F and a reverse direction R (FIG. 6(*a*)). The carriage mounts an ink head 190 thereon. In other wards, the CR motor 16 moves the ink head 190 via the carriage 60 selectively in the forward direction F and the reverse direction R.

Figure 2A:
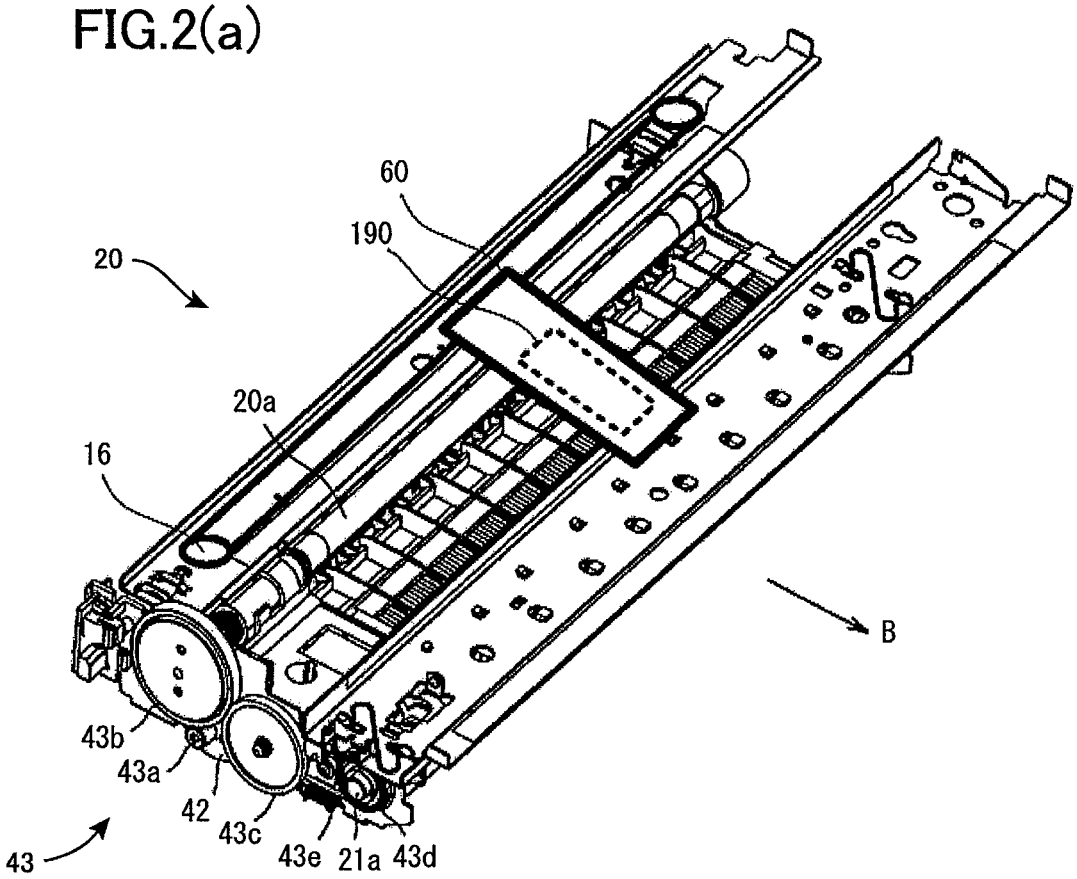
FIG. 2 (*a*) is a perspective view of a convey unit of the printer.
Figure 2B:
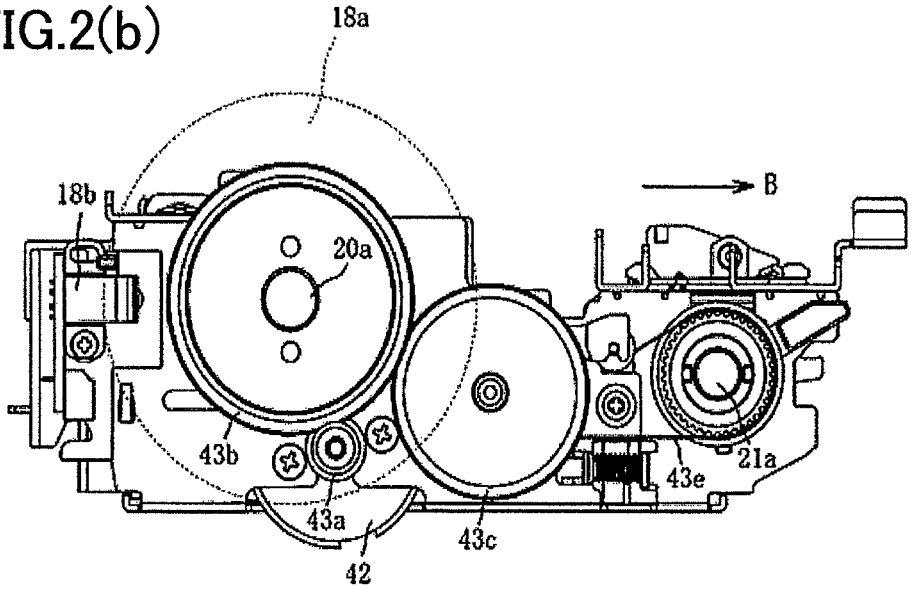

The LF motor driving circuit 41 is connected to and controls a LF motor 42, which in turn drives a convey roller 20*a* (FIG. 2(*a*)) to rotate. The convey roller 20*a* is for conveying a recording medium in a paper-conveying direction B (FIG. 2(*a*)), which is a sub-scanning direction orthogonal to the main scanning direction.

The CR encoder 17 is a linear encoder for detecting a moving amount of the carriage 60. Based on the moving amount detected by the CR encoder 17, the reciprocal movement of the carriage 60 in the main scanning direction is controlled.

The LF encoder 18 is a rotary encoder for detecting a rotating amount of the convey roller 20*a* (FIG. 2(*a*)), and the convey roller 20*a* is controlled based on the rotating amount detected by the LF encoder 18.

The gate array 6 is for transferring, based on the print timing signals transferred from the CPU 2 and image data stored in the image memory 7, print data (a drive signal) and other signals, such as transfer clock, in synchronization with the print data to the carriage circuit board 13. The gate array 6 also stores image data received via a USB or other interface 44 from a personal computer, digital camera, or the like into the image memory 7.

The ink head 190 has a row of nozzles 191 formed in a bottom surface thereof (the surface that opposes the recording medium) for each of ink colors, such as cyan, magenta, yellow, blue, and black. The nozzles 191 in each row are aligned in the sub-scanning direction at a prescribed nozzle pitch.

Each row of nozzles 191 corresponding to a color of ink may be arranged linearly or in a staggered formation. Further, one or a plurality of rows of nozzles 191 may be provided for each color of ink, and the number of rows may be set as needed for each color.

Ink cartridges (not shown) storing ink in each color are connected to each of the nozzles 191 in the ink head 190 via ink channels (not shown) and supply ink thereto.

The carriage circuit board 13 includes a head driver (drive circuit; not shown). The head driver is connected to piezoelectric actuators for each nozzle 191 formed in the ink head 190 by a flexible circuit board 19 configured of a copper foil wiring pattern formed on polyimide film having a thickness of 50-150 μm. The CPU 2 controls the head driver through the gate array 6 to apply drive voltages to each piezoelectric actuator as needed. The drive voltages cause ink of a prescribed amount to be ejected from the ink head 190 toward a recording medium positioned beneath the ink head 190.

The printer 1 further includes a convey unit 20 shown in FIG. 2(*a*) for conveying a recording medium. The convey unit 20 includes the convey roller 20*a*, a discharge droller 21*a*, the LF motor 42, and a transmitting mechanism 43. The LF motor 42 is rotatable both in a forward direction and a reverse direction.

The transmitting mechanism 43 is for transmitting driving force from the LF motor 42 to the convey roller 20*a* and the discharge droller 21*a*. The transmitting mechanism 43 includes a pinion 43*a* attached to a drive shaft (not shown) of the LF motor 42, a transmission gear 43*b* engaged with the pinion 43*a*, an intermediate gear 43*c* engaged with the transmission gear 43*b*, a discharge gear 43*d*, and a transmission belt 43*e* wound around and extending between the intermediate gear 43*c* and the discharge gear 43*d*. The transmission gear 43*b* is mounted on the left end of the convey roller 20*a*, and the discharge gear 43*d* is mounted on the left end of the discharge roller 21*a*.

Although not shown in the drawings, the convey roller 20*a* opposes a pinch roller and pinches a recording medium therebetween, and the discharge roller 21*a* opposes another pinch roller and pinches the recording medium therebetween. When driven in the forward rotation, the LF motor 42 drives the convey roller 20*a* and the discharge roller 21*a* to rotate, and the convey roller 20*a* and the discharge roller 21*a* convey the recording medium downstream in the paper-conveying direction B.

The LF encoder 18 has a slitted rotating plate 18*a* that is mounted in a position indicated by a dotted line in FIG. 2(*b*). The slitted rotating plate 18*a* has slits formed at prescribed intervals along its circumference. The LF encoder 18 detects the number of slits in the slitted rotating plate 18*a* that pass a photosensor 18*b* (equivalent to the rotational distance of the convey roller 20*a*) and outputs a pulse signal corresponding to the rotational distance of the convey roller 20*a*. As shown in FIG. 2(*b*), the slitted rotating plate 18*a* rotates coaxially with the convey roller 20*a* in this embodiment.

The CPU 2 generates a control signal based on a bias between the rotational distance of the convey roller 20*a* detected by the LF encoder 18 and a target rotational distance and controls the LF motor 42 through feedback based on the control signal in order to rotate the convey roller 20*a* a distance to compensate for the bias from the target rotational distance. Consequently, the recording medium can be conveyed the desired conveying distance to a target position.

Next, an adjustment pattern printing process and a calibration value acquisition process will be described with reference to FIGS. 3(*a*) to 4(*b*). The manufacturer performs these processes through prescribed operations prior to shipping the product. The processes are executed by the CPU 2 based on the adjustment pattern printing program 3*c* and the calibration value acquisition program 3*d* stored in the ROM 3.

Figure 4A:
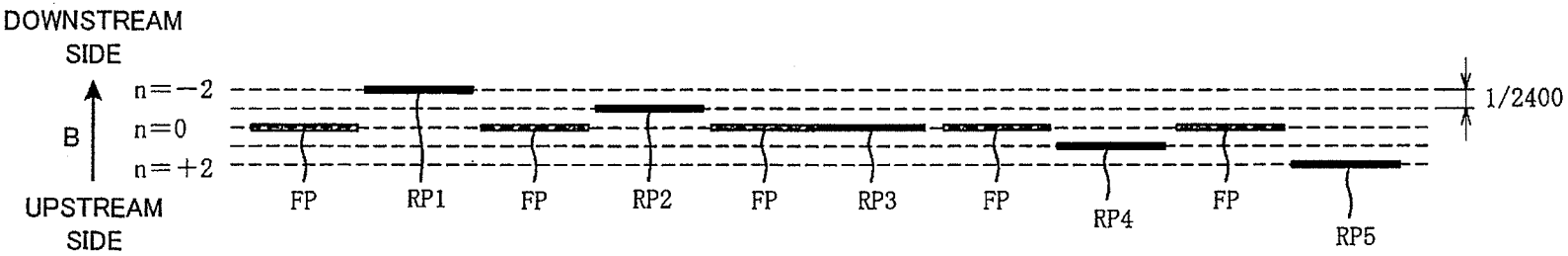
FIG. 4(*a*) is a view conceptually illustrating ideal print results of the adjustment pattern printing process.
Figure 4B:
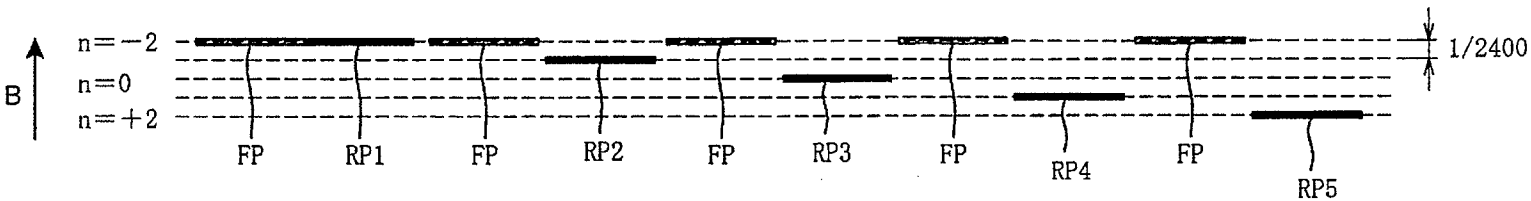

The adjustment pattern printing process is executed to print a prescribed adjustment pattern shown in FIG. 4(*a*). Based on printed results, the manufacturer can discern whether the ink head 190 deviates in the sub-scanning direction when conveyed in the main scanning direction. In the following description, the position of the ink head 190 in the sub-scanning direction when conveyed in the forward direction F will be referred to as "forward head position," and the position of the ink head 190 in the sub-scanning direction when conveyed in the reverse direction R will be referred to as "reverse head position." Thus, offset between the forward head position and the reverse head position will appear as offset between printing positions in the forward print and the reverse print.

In the adjustment pattern printing process, one adjustment pattern RP is printed by reverse printing at each position corresponding to the value of a variable n. Specifically, adjustment patterns RP1-RP5 are sequentially formed at each printing position corresponding to n=−2 to n=+2. Further, when the variable n is 0, an adjustment pattern FP is printed by forward printing.

Figure 3A:
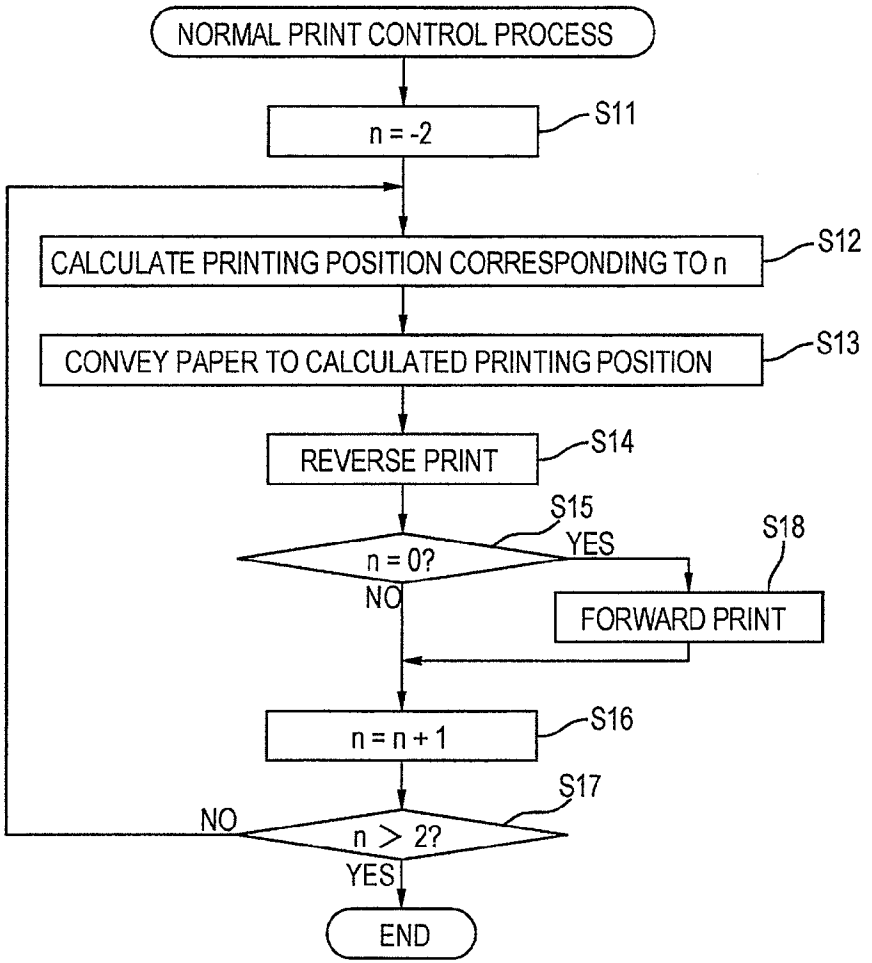
FIG. 3(*a*) is a flowchart representing an adjustment pattern printing process according to the embodiment.
Figure 3B:
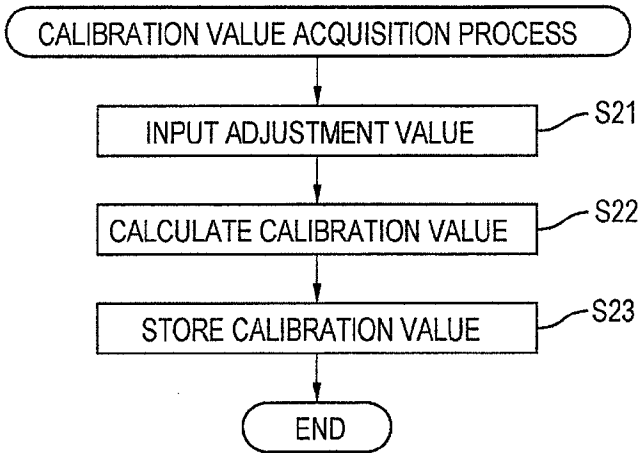

More specifically, in S11 of the adjustment pattern printing process shown in FIG. 3(*a*), the CPU 2 initializes the variable n to −2. In S12, the CPU 2 calculates a printing position corresponding to the value of the variable n, and in S13, conveys a recording medium to the printing position. The meaning of "conveying a recording medium to a printing position" in this description more precisely means that the recording medium is conveyed to a prescribed position at which printing can be performed at the printing position on the recording medium.

In S14, the CPU 2 conveys the ink head 190 to a reverse print starting position and begins printing the adjustment pattern RP (the adjustment pattern RP1 in this case, see FIG. 4(*a*)) by reverse printing using one of the nozzles 191 formed in the ink head 190 (for example, the nozzle 191 positioned substantially in the center of the nozzles 191 in the sub-scanning direction for black ink).

In S15, the CPU 2 determines whether the value of the variable n is 0. If not (S15: NO), the CPU 2 advances to S16. However, if so (S15: YES), then in S18, the CPU 2 prints the adjustment pattern FP (see FIG. 4(*a*)) by forward printing using the same nozzle 191, and subsequently advances to S16.

In S16, the CPU 2 increments the value of variable n by 1. Then, in S17, the CPU 2 determines whether or not the value of the variable n is greater than 2. If not (S17: NO), then the CPU 2 returns to S12. On the other hand, if so (S17: YES), then the adjustment pattern printing process ends.

It should be noted that when n=+1 in S14 (i.e., immediately after performing the forward print for n=0), the ink head 190 is already at the reverse print starting position, so the operation for conveying the ink head 190 to the reverse print starting position is unnecessary.

In an ideal case in which no offset occurred between the forward head position and the reverse head position, the printing results obtained by executing the adjustment pattern printing process will look like that shown in FIG. 4(*a*). However, when offset occurred between the forward head position and the reverse head position, the printing results will look something like that shown in FIG. 4(*b*).

To facilitate understanding of the drawings in FIGS. 4(*a*) and 4(*b*), the printing positions for reverse prints corresponding to each value of the variable n are indicated by dotted lines. Further, in order to help visually distinguish the adjustment patterns RPs printed in reverse prints and the adjustment pattern FP printed in a forward print, the former is depicted by a solid line and the latter by rectangles with hatching that resemble a solid line.

In the adjustment pattern printing process described above, the adjustment pattern RP (adjustment patterns RP1-RP5) is printed one at a time in a reverse print each time the variable n is changed sequentially from −2 to +2, i.e., each time the recording medium is conveyed one unit (1/2400 inches in this embodiment) in the paper-conveying direction B, and the adjustment pattern FP is printed in a forward print when the variable n is 0.

Hence, in an ideal case in which there is no offset, the adjustment pattern FP printed in the forward print is aligned with the adjustment pattern RP3 printed in the reverse print when the variable n is 0, as shown in FIG. 4(*a*).

However, when there is offset between the forward head position and the reverse head position, the adjustment pattern FP is not aligned with the adjustment pattern RP3, as shown in FIG. 4(*b*).

In the example shown in FIG. 4(*b*), the adjustment pattern FP is aligned with the adjustment pattern RP1 printed in the reverse print when the variable n is −2. In this example, the reverse head position is farther upstream of the forward head position in the paper-conveying direction B.

Be cause a recording medium is printed beginning from the downstream end thereof, this case in which the reverse head position is upstream of the forward head position is equivalent to a case in which the recording medium is conveyed too far. Therefore, it is necessary to reduce the paper-conveying distance in this situation. To do this, an adjustment value is set to the value of the variable n corresponding to the adjustment pattern RP aligned with the adjustment pattern FP. In the example of FIG. 4(*b*), the adjustment value is set to −2.

The calibration value acquisition process is executed to find an amount of calibration for calibrating the paper-conveying distance based on the adjustment value found above.

In S21, at the beginning of the calibration value acquisition process of FIG. 3(*b*), the manufacturer inputs the adjustment value obtained from the printing results in the adjustment pattern printing process described above.

In this embodiment, the manufacturer visually determines the position at which the adjustment pattern FP matches an adjustment pattern RP (RP1-RP5) and sets the adjustment value based on this position, and inputs the adjustment value manually as a numeric value in S21.

In S22, the CPU 2 calculates a calibration value (a value for calibrating the paper-conveying distance) based on the inputted adjustment value. As described above, the adjustment value indicates the amount of offset between the forward head position and the reverse head position. Because the adjustment patterns RP1-RP5 are printed at intervals of 1/2400 inches in the paper-conveying direction B, an offset between the forward head position and the reverse head position in the example shown in FIG. 4(*b*) is (1/2400 inches)×(−2)=−1/1200 inches. Hence, by calibrating the paper-conveying distance by exactly −1/1200 inches when performing a reverse print, the printing position of the reverse print can be aligned with the intended printing position. Accordingly, the calibration value in this example is −1/1200.

In S23, the CPU 2 stores the calibration value calculated in S22 into the calibration memory 5*a* and subsequently ends the calibration value acquisition process.

Be cause a forward print is executed when the variable n is 0 in the above-described adjustment pattern printing process, the adjustment value and the calibration value are both negative values when the reverse head position is upstream of the forward head position, as in the above example. On the other hand, if the reverse head position is downstream of the forward head position, the adjustment value and the calibration value are both positive. When the adjustment value is +2, for example, the calibration value is set to +1/1200 obtained from the multiplication (1/2400)×(+2).

Hence, in this embodiment, it is possible to determine whether the reverse head position is upstream or downstream of the forward head position based on whether the adjustment value and the calibration value are positive or negative. When the offset is 0, the calibration value is set to 0.

Next, a normal printing process executed in the printer 1 of this embodiment will be described with reference to the flowchart of FIG. 5. The normal printing process is executed by the CPU 2 based on the normal printing control program 3*a* stored in the ROM 3 when the user has issued a print command while normal bi-directional printing is selected. Normal bi-directional printing is a printing process performed with different printing positions for a forward print and a reverse print (i.e., single-pass printing).

For simplification, the following description will assume that each printing with one pass of the ink head 190 in either the forward direction F or the reverse direction R forms an image with a printing resolution equivalent to a nozzle resolution (600 dpi, for example) of the nozzles 191 formed in the ink head 190 along the sub-scanning direction.

Figure 5:
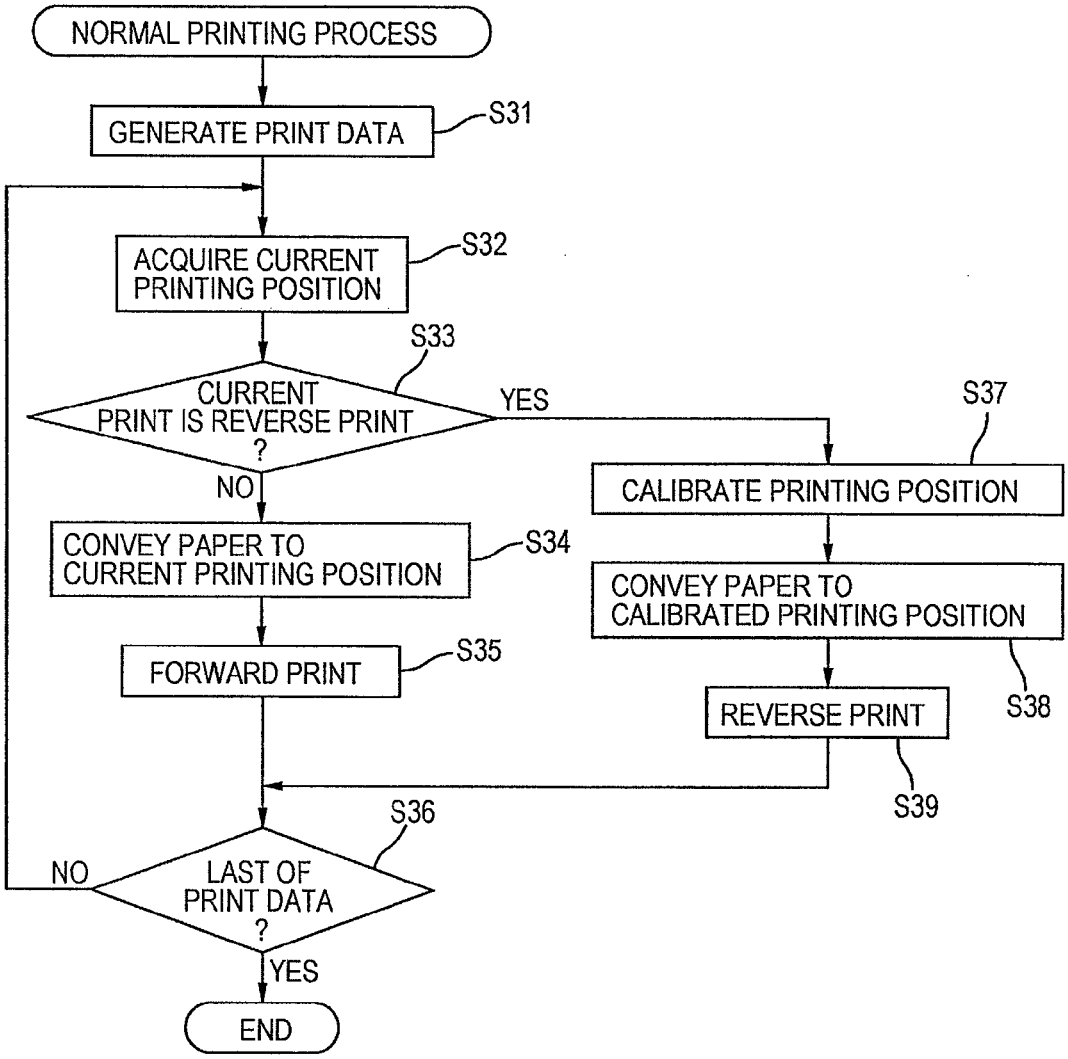
FIG. 5 is a flowchart representing a normal printing process according to the embodiment.

In S31 of the normal printing process shown in FIG. 5, the CPU 2 generates print data from image data to be printed (image data inputted from a PC, for example).

In S32, the CPU 2 acquires a printing position for a current print (a current printing position). If S represents the current printing position, S0 a print starting position, M a conveying distance per pass defined according to a printing mode, and P the number of passes, then the current printing position can be obtained from the equation S=S0+M33 (P−1).

Be cause the printing resolution for one pass in either a forward print or a reverse print is equivalent to the nozzle resolution in this example, when N represents the number of nozzles 191 aligned in the sub-scanning direction and R represents a nozzle pitch (distance) in the sub-scanning direction, the conveying distance M can be obtained from the equation M=N×R.

Thus, the current printing position S can be expressed by the equation S=(print starting position S0)+(N×R)×(P−1)

Then, it is determined in S33 whether or not the current print is a reverse print. If not (S33: NO), then, in S34, the recording medium is conveyed to the current printing position acquired in S32. In other words, the recording medium is conveyed to a position at which the ink head 190 can print on the recording medium at the current printing position.

More specifically, in S34, the CPU 2 sets a paper-conveying distance (target rotational amount of the convey roller 20*a*) to a difference between the current printing position calculated in S32 and a previous printing position, and conveys the recording medium to the current printing position by rotating the convey roller 20*a* the target rotational amount while detecting the rotational amount of the convey roller 20*a* with the LF encoder 18.

For example, when the current print is a forward print in the $P^{th}$ pass, excluding the forward print in the $1^{st}$ pass, the previous print is a reverse print in the $(P-1)^{th}$ pass. As described above, the current printing position S for the forward print in the $P^{th}$ pass (where P>1) is expressed by (print starting position S0)+(N×R)×(P−1).

On the other hand, the previous printing position, i.e., a printing position for the reverse print in the $(P-1)^{th}$ pass, is expressed by (print starting position S0)+(N×R)×(P−2)+γ, where γ represents the calibration value stored in the calibration memory 5*a*.

Accordingly, the paper-conveying distance for the forward print of the $P^{th}$ pass (where P>1) is [S0+(N×R)×(P−1)]−[S0+(N×R)×(P−2)+γ]=(N×R)−γ.

In S35, the CPU 2 performs the forward print and advances to S36.

However, if the current print is a reverse print (S33: YES), then in S37, the CPU 2 obtains a calibrated printing position by calibrating the current printing position acquired in S32 with the calibration value stored in the calibration memory 5*a* (in other words, sets a current printing position to the calibrated printing position).

More specifically, the calibrated printing position S' can be found from the equation S'=(current printing position S)+γ. If the value −1/1200 is stored in the calibration memory 5*a* as in the example shown in FIG. 4(*b*), the calibrated printing position S' is (current printing position S)+(−1/1200). Alternatively, because the current printing position S is equivalent to (print starting position S0)+(N×R)×(P−1), the calibrated printing position can be expressed by S'=(print starting position S0)+(N×R)×(P−1)+γ.

In S38, the CPU 2 conveys the recording medium to the calibrated printing position (calibrated current printing position) S' obtained in S37. Specifically, the CPU 2 sets the paper-conveying distance (the target rotational amount of the convey roller 20*a*) to a difference between the calibrated printing position obtained in S37 and a previous printing position and conveys the recording medium to the calibrated printing position by rotating the convey roller 20*a* the target rotational amount while detecting the rotational amount of the convey roller 20*a* with the LF encoder 18.

For example, when the current print is a reverse print in the $P^{th}$ pass, the previous print is a forward print in the $(P-1)^{th}$ pass. Accordingly, the calibrated printing position for the reverse print in the $P^{th}$ pass (where P≧2 Because reverse printing is performed during the return of the ink head 190) is expressed by (print starting position S0)+(N×R)×(P−1)+γ. On the other hand, the previous printing position, i.e., a printing position for the forward print in the $(P-1)^{th}$ pass is expressed by (print starting position S0)+(N×R)×(P−2). Accordingly, the paper-conveying distance for the reverse print in the $P^{th}$ pass (where P≧2) is [S0+(N×R)×(P−1)+γ]−[S0+(N×R)×(P−2)]=(N×R)+γ.

In S39, the CPU 2 performs the reverse print and subsequently advances to S36. In S36, the CPU 2 determines whether the print data just printed was the last of the print data. If there still remains data to be printed (S36: NO), the CPU 2 returns to S32 and repeats the above processes on print data that has not been printed. However, if the last of the print data has been printed (S36: YES), the CPU 2 ends the normal printing process.

Figure 6A:
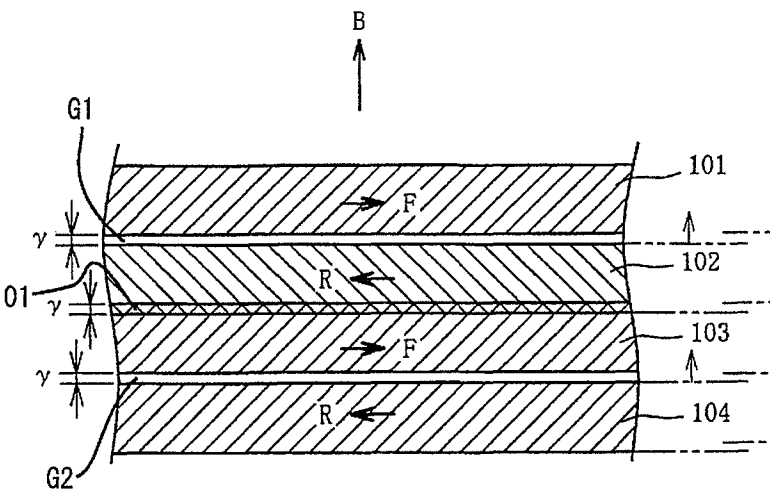
FIG. 6(*a*) is a view conceptually illustrating printing results obtained when the reverse head position is offset from the forward head position upstream in a paper-conveying direction.
Figure 6B:
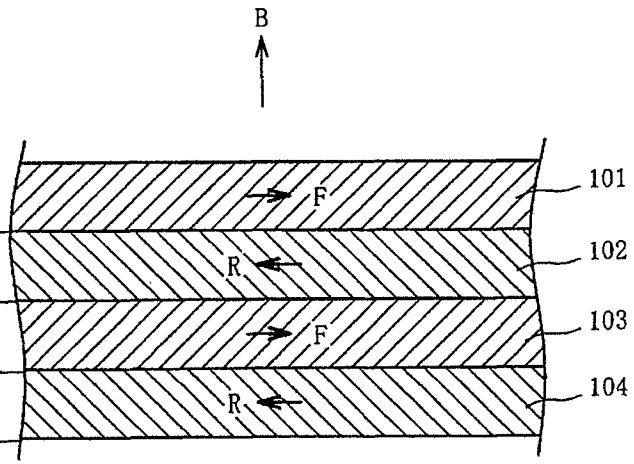

Next, the effects obtained by executing the normal printing process in FIG. 5 will be described with reference to FIGS. 6(*a*) and 6(*b*). FIG. 6(*a*) conceptually illustrates printing results obtained without calibrating the paper-conveying distance when the reverse head position is offset from the forward head position upstream in the paper-conveying direction B. FIG. 6(*b*) conceptually illustrates printing results obtained when executing the normal printing process in FIG. 5.

As shown in FIG. 6(*a*), when the reverse head position is offset from the forward head position upstream in the paper-conveying direction B, gaps G1 and G2 having widths γ equivalent to the amount of offset in the paper-conveying direction B are respectively generated between a printing region 101 printed in a $P^{th}$ pass of a forward print and a printing region 102 printed in a $(P+1)^{th}$ pass of a reverse print, and between a printing region 103 printed in a $(P+2)^{th}$ pass of a forward print and a printing region 104 printed in a $(P+3)^{th}$ pass of a reverse print. Further, an overlapping part O1 is produced by the printing region 102 of the $(P+1)^{th}$ pass overlapping the printing region 103 of the $(P+2)^{th}$ pass by a width γ.

However, in the normal printing process of FIG. 5 described above, a printing position is calibrated by a distance equal to the width γ only in reverse prints. Accordingly, as shown in FIG. 6(*b*), the printing regions 102 and 104 printed in reverse prints are offset in the paper-conveying direction B downstream of a precalibrated printing positions shown in FIG. 6(*a*).

As a result, the gaps G1 and G2 and the overlapping part O1 are eliminated, producing ideal printing results.

Hence, when printing at a resolution equivalent to the nozzle resolution in one pass of either a forward print or a reverse print, the printer 1 can suppress a decline in image quality caused by offset between the forward head position and the reverse head position.

It should be noted that the normal printing process of FIG. 5 can also be applied to cases in which a higher printing resolution than the nozzle resolution is obtained through multiple passes. That is, when multiple passes are performed to obtain a higher printing resolution than the nozzle resolution, the occurrence of offset of printing positions in the sub-scanning direction can produce narrow banding at periods related to the nozzle pitch, resulting in a decline in image quality. However, the printer 1 of this embodiment adjusts the reverse head position to an ideal position with respect to the forward head position by performing calibration based on the offset between these positions during reverse prints, thereby suppressing the occurrence of narrow banding at periods related to the nozzle pitch.

Next, an overlap printing process executed by the printer 1 of this embodiment will be described with reference to FIG. 7. The CPU 2 of the printer 1 executes the overlap printing process based on the overlap printing control program 3*b* stored in the ROM 3 when the user has issued a print command while overlap printing is selected. In the overlap printing process, after one of a forward print and a reverse print is performed, another one of the forward print and the reverse print is executed over the printed results of the one of the forward print and the reverse print.

Figure 7:
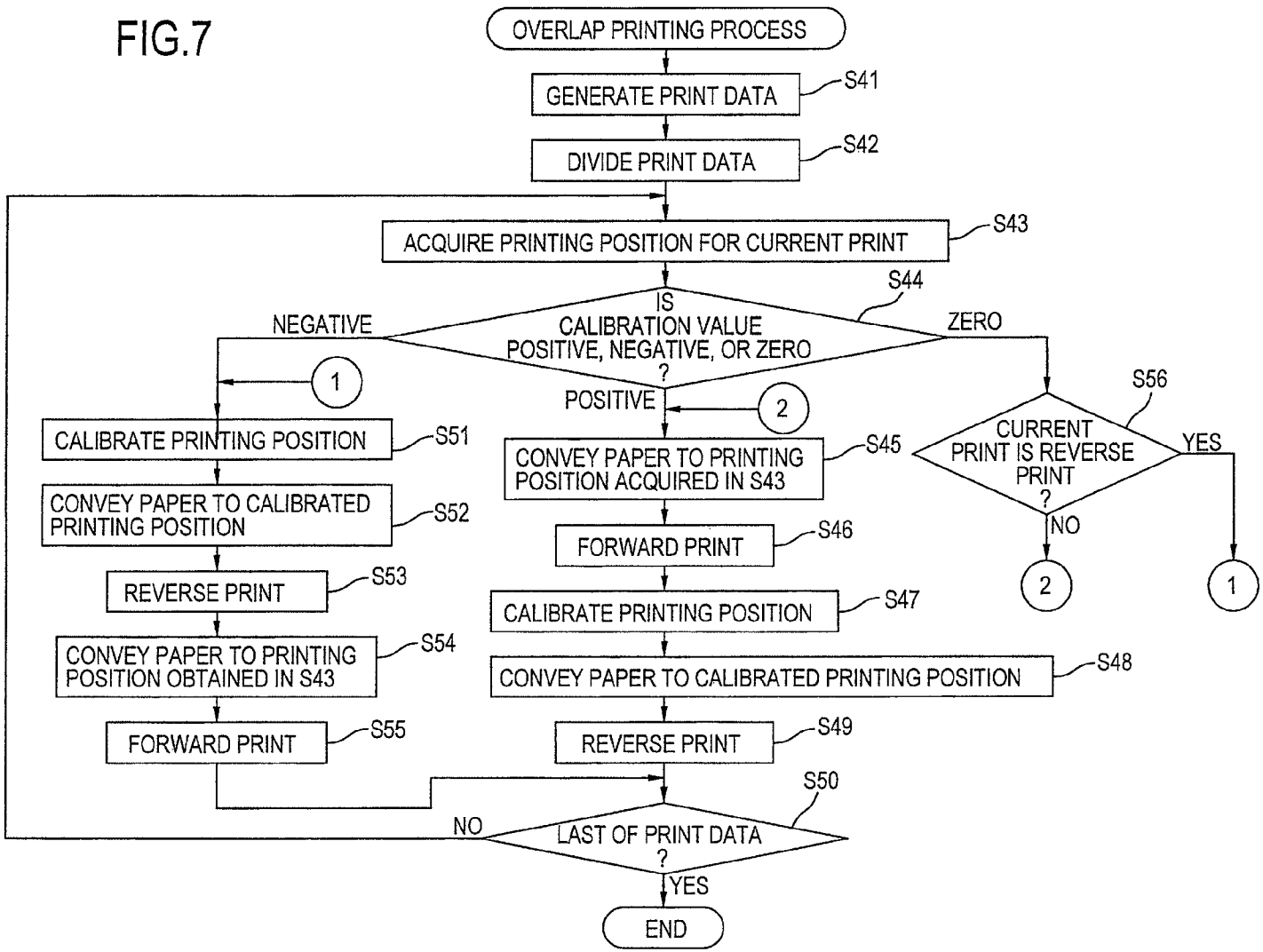
FIG. 7 is a flowchart representing an overlap printing process according to the embodiment.

In S41 of the overlap printing process shown in FIG. 7, the CPU 2 generates print data from image data to be printed (image data inputted from a PC, for example). In S42, the CPU 2 divides the print data into forward print data and reverse print data.

In S43, the CPU 2 acquires a printing position for a current print (a current printing position). Specifically, the CPU 2 calculates the current printing position S based on the equation S=(print starting position S0)+(N×R)×([(P−1)/2]), where the brackets "[ ]" denote the Gaussian symbol.

In S44, the CPU 2 determines whether the calibration value stored in the calibration memory 5*a* is a positive value, a negative value, or zero. In the case of a positive value, i.e., when the reverse head position is downstream of the forward head position (S44: positive), then in S45, the CPU 2 conveys a recording medium to the current printing position acquired in S43.

Specifically, the CPU 2 sets the paper-conveying distance (the target rotational amount of the convey roller 20*a*) to a difference between the current printing position calculated in S43 and a previous printing position and conveys the recording medium to the current printing position by rotating the convey roller 20*a* the target rotational amount while detecting the rotational amount of the convey roller 20*a* with the LF encoder 18.

Then, in S46, the CPU 2 performs the forward print, and advances to S47. In S47, the CPU 2 obtains a calibrated printing position by calibrating the current printing position acquired in S43 with the calibration value stored in the calibration memory 5*a* (in other words, sets a current printing position to the calibrated printing position). More specifically, the calibrated printing position S' can be found from the equation S'=(current printing position S)+γ, where γ represents the calibration value stored in the calibration memory 5*a*.

Then, in S48, the CPU 2 conveys the recording medium to the calibrated printing position acquired in S47. Specifically, the CPU 2 sets the paper-conveying distance (the target rotational amount of the convey roller 20*a*) to a difference between the calibrated printing position calculated in S47 and a previous printing position (i.e., the current printing position acquired in S43, in this case) and conveys the recording medium to the calibrated printing position by rotating the convey roller 20*a* the target rotational amount while detecting the rotational amount of the convey roller 20*a* with the LF encoder 18.

Then, in S49, the CPU 2 performs the reverse print, and then the CPU 2 advances to S50.

If the CPU 2 determines in S44 that the calibration value stored in the calibration memory 5*a* is a negative value, i.e., when the reverse head position is upstream of the forward head position (S44: negative), then in S51, the CPU 2 obtains a calibrated printing position by calibrating the current printing position acquired in S43 with the calibration value stored in the calibration memory 5*a* in the same manner as in S47 (in other words, sets a current printing position to the calibrated printing position).

Then, in S52, the CPU 2 conveys a recording medium to the calibrated printing position acquired in S51. More specifically, in S52, the CPU 2 sets the paper-conveying distance (the target rotational amount of the convey roller 20*a*) to a difference between the calibrated printing position and a previous printing position and conveys the recording medium to the calibrated printing position by rotating the convey roller 20*a* the target rotational amount while detecting the rotational amount of the convey roller 20*a* with the LF encoder 18.

Then, in S53, the CPU 2 performs the reverse print, and then advances to S54. Note that if the reverse print being performed in S53 is the first print, the CPU 2 first conveys the ink head 190 to the reverse print starting position before executing the reverse print.

In S54, the CPU 2 conveys the recording medium to the current printing position acquired in S43. More specifically, the CPU 2 sets the paper-conveying distance (the target rotational amount of the convey roller 20*a*) to a difference between the current printing position obtained in S43 and a previous printing position (i.e., the calibrated printing position obtained in S51, in this case) and conveys the recording medium to the current printing position by rotating the convey roller 20*a* the target rotational amount while detecting the rotational amount of the convey roller 20*a* with the LF encoder 18.

Then, in S55, the CPU 2 performs the forward print, and then advances to S50.

If it is determined that the calibration value stored in the calibration memory 5*a* is zero (S44: zero), then, in S56, the CPU 2 determines whether the current print is a reverse print. If not (S56: NO), then the CPU 2 advances to S45. On the other hand, if so (S56: YES), then the CPU 2 advances to S51.

In S50, the CPU 2 determines whether the print data just printed was the last of the print data. If there still remains data to be printed (S50: NO), the CPU 2 returns to S43 and repeats the above processes on print data that has not been printed. However, if the last of the print data has been printed (S50: YES), the CPU 2 ends the overlap printing process.

Next, the effects obtained by executing the overlap printing process in FIG. 7 will be described with reference to FIGS. 8(*a*) and 8(*b*).

Figure 8A:
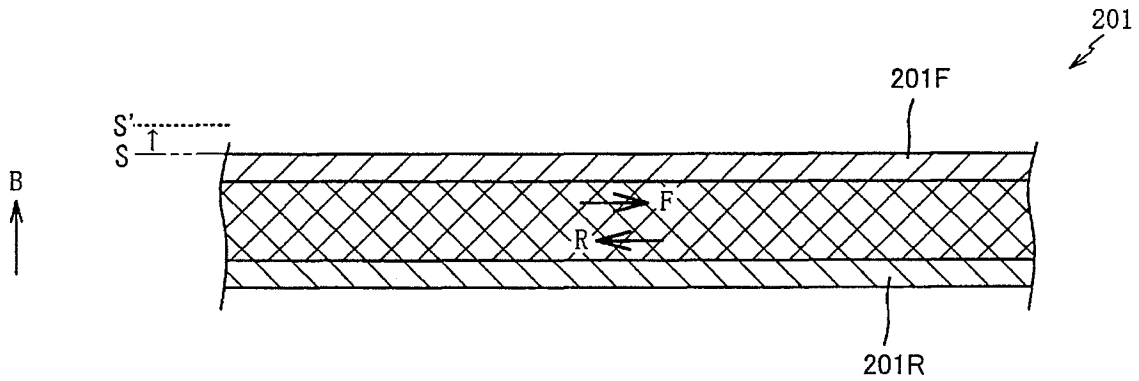
FIG. 8(*a*) is a view conceptually illustrating results of overlap printing when the reverse head position is shifted upstream of the forward head position in the paper-conveying direction.
Figure 8B:
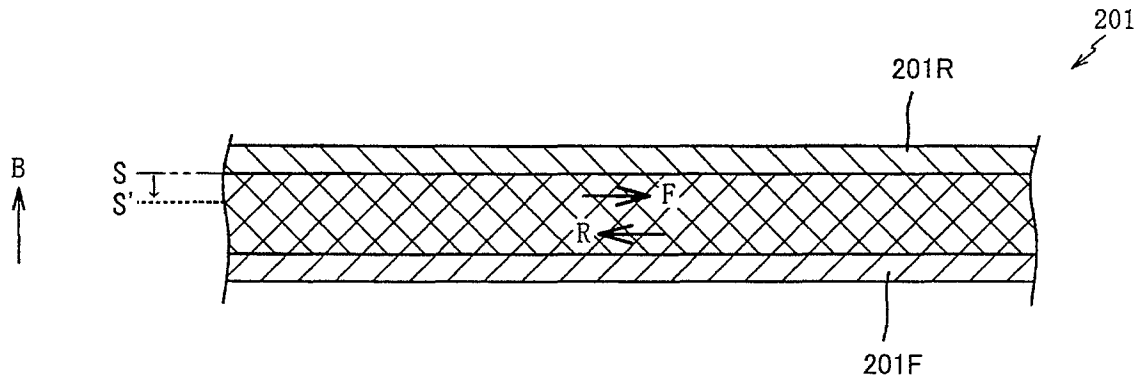

When the reverse head position is offset from the forward head position, the printing position in a forward print is offset from the printing position for a reverse print in overlap printing as shown in FIG. 8(*a*) or 8(*b*) if no calibration is performed, resulting in a decline in image quality. FIGS. 8(*a*) and 8(*b*) show only a printing region 201 in which dots are formed by a single forward print and a single reverse print. Within the printing region 201, a region 201F indicates the portion in which dots are formed in the forward print and a region 201R indicates the portion in which dots are formed in the reverse print.

FIG. 8(*a*) conceptually illustrates results of overlap printing when the reverse head position is shifted upstream of the forward head position in the paper-conveying direction B. FIG. 8(*b*) conceptually illustrates results of overlap printing when the reverse head position is shifted downstream of the forward head position in the paper-conveying direction B.

In these cases, overlap printing with no offset can be executed by performing the forward print at the printing position S and the reverse print at the calibrated printing position S' according to the overlap printing process of the embodiment.

However, when the reverse head position is offset upstream of the forward head position as shown in FIG. 8(*a*), it is necessary to convey the recording medium in reverse (i.e., the direction opposite the paper-conveying direction B) after performing a forward print in order to perform a reverse print over the printed results of the forward print.

By performing the overlap printing process of FIG. 7 according to this embodiment, it is possible to perform the reverse print before the forward print when the calibration value stored in the calibration memory 5*a* is a negative value, by setting the printing position for the reverse print to the calibrated printing position S'. Accordingly, the overlap printing process can be performed without having to convey the recording medium in reverse.

On the other hand, when the reverse head position is offset downstream of the forward head position as shown in FIG. 8(*b*), it is necessary to convey the recording medium in reverse after performing a reverse print in order to perform a forward print over the print results of the reverse print.

However, according to the overlap printing process in FIG. 7, when the calibration value stored in the calibration memory 5*a* is a positive value, the forward print is performed first at the non-calibrated printing position S, after which the reverse print is performed at the calibrated printing position S'. In this way, the overlap printing process can be performed without having to convey the recording medium in reverse.

Thus, the initial printing direction (i.e., the forward direction F or the reverse direction R) in an overlap print is set to the direction for which the ink head 190 is positioned upstream in the paper-conveying direction B. Accordingly, the printer 1 can perform overlap printing without having to convey the recording medium in the direction opposite the paper-conveying direction B.

By calibrating the printing position for a reverse print based on the offset between the reverse head position and the forward head position, the printer 1 according to this embodiment can align a printing position in a reverse print with a printing region in a forward print. Accordingly, the printer 1 suppresses a decline in image quality caused by offset between the forward head position and the reverse head position.

As described above, during bi-directional printing, the printer 1 according to this embodiment sets a printing position for a forward print based on a print condition or print mode (single-pass printing or overlap printing, for example), regardless of offset in the position of the ink head 190, but calibrates the printing position for a reverse print based on the positional offset. Therefore, the printer 1 can set the reverse head position to an ideal position in relation to the forward head position and can suppress a decline in image quality caused by offset between the forward head position and the reverse head position in bi-directional printing.

Further, the offset (adjustment value) can easily be obtained based on the adjustment pattern FP and the adjustment patterns RPs (FIG. 4(*a*)) using a single nozzle 191 formed in the ink head 190.

While the invention has been described in detail with reference to the embodiment thereof, it would be apparent to those skilled in the art that various changes and modifications may be made therein without departing from the spirit of the invention.

For example, in the above-described embodiment, the printer 1 calibrates a printing position for a reverse print but not a printing position for a forward print. However, the printer 1 may be configured to calibrate a printing position for a forward print rather than a reverse print.

Further, when performing single-pass printing in the above-described embodiment, the current printing position S is found according to the equation (current printing position S)=(print starting position S0)+(N×R)×(P−1). However, the printer 1 may be configured to account for conveyance error by calculating the current printing position S according to the equation (current printing position S)=(print starting position S0)+(N×R+α)×(P−1), where α is an adjustment amount needed to compensate for conveyance error. The printer 1 may also account for conveyance error in overlap printing.

In the above-described embodiment, the calibration memory 5*a* stores the calibration value obtained in S22 of the process in FIG. 3(*b*), but the calibration memory 5*a* may instead store the adjustment value inputted in S21. In this case, the calibration value is calculated based on the adjustment value in S37 of FIG. 5 and S47 and S51 of FIG. 7.

In the above-described embodiment, the adjustment pattern printing process of FIG. 3(*a*) and the calibration value acquisition process of FIG. 3(*b*) are executed in the factory prior to shipping the product. However, the printer 1 may be configured to execute these processes when the user performs a prescribed operation and to store the acquired calibration value into the calibration memory 5*a*.

In the adjustment pattern printing process of FIG. 3(*a*), the printer 1 is configured to print the adjustment pattern FP in a forward print in one line and to print the adjustment patterns RP1-RP5 in reverse prints for sequential lines. However, the printer 1 may conversely be configured to print an adjustment pattern in a reverse print in one line and to print multiple adjustment patterns in forward prints for sequential lines.

In the above-described embodiment, the manufacturer obtains an adjustment value visually based on the printed results of the adjustment pattern printing process. However, the printed results may be read as image data with an image-reading device such as a scanner or CCD camera, and an image sensor may be used to determine the position at which the adjustment pattern FP is aligned with an adjustment pattern RP and to output an adjustment value obtained for this position of alignment. In this case, the adjustment value may be outputted to a monitor or to the printer 1 via a cable. In the latter case, the printer 1 may be configured to execute the calibration value acquisition process of FIG. 3(*b*) upon receiving the inputted adjustment value. The device acquiring the adjustment value based on the position at which the adjustment pattern FP is aligned with an adjustment pattern RP may be an external device or a device built into the printer 1.

What is claimed is:

1. An image forming device comprising:

a print head that comprises a plurality of print elements and that is configured to form an image on a recording medium;

a moving mechanism that moves the print head reciprocatingly in a forward direction and a reverse direction opposite from the forward direction, wherein the print head performs bi-directional printing including a first print for forming a first image while being moved in the forward direction and a second print for forming a second image while being moved in the reverse direction;

a storing unit that stores a value relating to an amount of offset in a conveying direction between a first position on the recording medium at which a first test image is formed in the first print when the recording medium is at a predetermined position and a second position on the recording medium at which a second test image is formed in the second print when the recording medium is at the predetermined position, the conveying direction being orthogonal to both the forward direction and the reverse direction, the first test image and the second test image being formed with a single print element of the plurality of print elements;

a position determining unit that determines which one of the first position and the second position is on a further upstream side in the conveying direction;

a print control unit that controls the print head in an overlap print mode to perform the first print and the second print in this order so as to form the first image over the second image when the position determining unit determines that the first position is on the further upstream side and to perform the second print and the first print in this order so as to form the second image over the first image when the position determining unit determines that the second position is on the further upstream side;

a conveying mechanism that conveys the recording medium in the conveying direction relative to the print head, the conveying mechanism conveying the recording medium a first amount prior to one of the first print and the second print and a second amount prior to the other of the first print and the second print; and a convey-amount determining unit that determines the second amount based on the value stored in the storing unit, the convey-amount determining unit comprising:

a first position determining unit that determines a first printing position based on a print condition;

a second position determining unit that determines a second printing position by calibrating the first printing position based on the value stored in the storing unit;

a setting unit that sets a current printing position to the first printing position if a current print is the one of the first print and the second print, and sets the current printing position to the second printing position if the current print is the other of the first print and the second print; and an amount determining unit that determines the first amount and the second amount based on a previous printing position and the current printing position, wherein the conveying mechanism conveys the recording medium the second amount upstream in the conveying direction prior to the other of the first print and the second print when the other of the first print and the second print is the second print and the second position is upstream of the first position in the conveying direction, and wherein the conveying mechanism conveys the recording medium the second amount downstream in the conveying direction prior to the other of the first print and the second print when the other of the first print and the second print is the second print and the second position is downstream of the first position in the conveying direction.

2. The image forming device according to claim 1, wherein the value stored in the storing unit is a distance between the first position and the second position in the conveying direction.

3. The image forming device according to claim 1, wherein the convey-amount determining unit determines the second amount by calibrating a predetermined amount based on the value stored in the storing unit, the predetermined amount being determined based on a print condition.

4. The image forming device according to claim 1, wherein the convey-amount determining unit determines the first amount by calibrating a predetermined amount based on the value stored in the storing unit, the predetermined amount being determined based on a print condition.

5. A control method for controlling an image forming device including a print head that comprises a plurality of print elements and that is configured to form an image on a recording medium by performing bi-directional printing, the bi-directional printing comprising a first print for forming a first image on a recording medium while moving in a forward direction and a second print for forming a second image on the recording medium while moving in a reverse direction opposite from the forward direction, and the control method comprising:

determining whether a current print is the first print or the second print;

performing a first control if the current print is one of the first print and the second print; and performing a second control if the current print is the other of the first print and the second print, wherein:

the first control includes:

conveying the recording medium a first amount in a conveying direction orthogonal to both the forward direction and the reverse direction; and performing the one of the first print and the second print; and the second control includes:

obtaining a second amount based on a value stored in a storing unit of the image forming device, the value relating to an amount of offset in the conveying direction between:

a first position on the recording medium at which a first test image is formed in the first print when the recording medium is at a predetermined position and a second position on the recording medium at which a second test image is formed in the second print when the recording medium is at the predetermined position, wherein the first test image and the second test image are formed with a single print element of the plurality of print elements;

determining which one of the first position and the second position is on a further upstream side in the conveying direction;

controlling the print head in an overlap print mode to perform the first print and the second print in this order so as to form the first image over the second image when it is determined that the first position is on the further upstream side and to perform the second print and the first print in this order so as to form the second image over the first image when it is determined that the second position is on the further upstream side;

conveying the recording medium the second amount in the conveying direction, wherein:

the recording medium is conveyed the second amount upstream in the conveying direction prior to the other of the first print and the second print when the other of the first print and the second print is the second print and the second position is upstream of the first position in the conveying direction, and the recording medium is conveyed the second amount downstream in the conveying direction prior to the other of the first print and the second print when the other of the first print and the second print is the second print and the second position is downstream of the first position in the conveying direction; and performing the other of the first print and the second print.

6. A storage medium storing a set of program instructions executable on a data processing device and usable for controlling an image forming device including a print head comprising a plurality of print elements and that is configured to form an image on a recording medium by performing bi-directional, the bi-directional printing comprising a first print for forming a first image on a recording medium while moving in a forward direction and a second print for forming a second image on the recording medium while moving in a reverse direction opposite from the forward direction, and the instructions comprising:

determining whether a current print is the first print or the second print;

performing a first control if the current print is one of the first print and the second print; and performing a second control if the current print is the other of the first print and the second print, wherein:

the first control includes:

conveying the recording medium a first amount in a conveying direction orthogonal to both the forward direction and the reverse direction; and performing the one of the first print and the second print; and the second control includes:

obtaining a second amount based on a value stored in a storing unit of the image forming device, the value relating to an amount of offset in the conveying direction between:

a first position on the recording medium at which a first test image is formed in the first print when the recording medium is at a predetermined position and a second position on the recording medium at which a second test image is formed in the second print when the recording medium is at the predetermined position, wherein the first test image and the second test image are formed with a single print element of the plurality of print elements;

determining which one of the first position and the second position is on a further upstream side in the conveying direction;

controlling the print head in an overlap print mode to perform the first print and the second print in this order so as to form the first image over the second image when it is determined that the first position is on the further upstream side and to perform the second print and the first print in this order so as to form the second image over the first image when it is determined that the second position is on the further upstream side;

conveying the recording medium the second amount in the conveying direction, wherein:

the recording medium is conveyed the second amount upstream in the conveying direction prior to the other of the first print and the second print when the other of the first print and the second print is the second print and the second position is upstream of the first position in the conveying direction, and the recording medium is conveyed the second amount downstream in the conveying direction prior to the other of the first print and the second print when the other of the first print and the second print is the second print and the second position is downstream of the first position in the conveying direction; and performing the other of the first print and the second print.

* * * * *